US006171054B1

(12) United States Patent
Mann, III et al.

(10) Patent No.: US 6,171,054 B1
(45) Date of Patent: Jan. 9, 2001

(54) IMPELLER HOUSING WITH REDUCED NOISE AND IMPROVED AIRFLOW

(75) Inventors: J. Adin Mann, III, Ames, IA (US); Robert N. McKee, Aurora; Doug S. Zlatic, North Royalton, both of OH (US)

(73) Assignee: Royal Appliance Mfg. Co., Cleveland, OH (US)

( * ) Notice: Under 35 U.S.C. 154(b), the term of this patent shall be extended for 0 days.

(21) Appl. No.: 09/407,377

(22) Filed: Sep. 28, 1999

(51) Int. Cl.[7] ..... F04D 29/42
(52) U.S. Cl. ..... 415/204; 415/119; 415/212.1
(58) Field of Search ..... 415/119, 203, 415/204, 206, 207, 212.1, 214.1

(56) References Cited

U.S. PATENT DOCUMENTS

| | | | | |
|---|---|---|---|---|
| 347,227 | | 8/1886 | Campbell . | |
| 3,773,432 | | 11/1973 | Chow et al. . | |
| 4,120,616 | | 10/1978 | Dwyer et al. . | |
| 4,330,899 | | 5/1982 | Miller et al. . | |
| 4,864,683 | | 9/1989 | Herron, Jr. et al. . | |
| 4,917,572 | * | 4/1990 | Van Houten | 415/206 |
| 5,046,922 | * | 9/1991 | Nakamura et al. | 415/172.1 |
| 5,159,738 | | 11/1992 | Sunagawa et al. . | |
| 5,289,612 | | 3/1994 | Glenn, III . | |
| 5,293,664 | | 3/1994 | Lim et al. . | |
| 5,353,469 | | 10/1994 | Fellhauer . | |
| 5,400,463 | | 3/1995 | Attard et al. . | |
| 5,511,939 | | 4/1996 | Tokunaga et al. . | |
| 5,513,417 | | 5/1996 | Kim et al. . | |
| 5,548,867 | | 8/1996 | Hwang et al. . | |
| 5,573,369 | | 11/1996 | Du . | |
| 5,588,178 | | 12/1996 | Liu . | |

FOREIGN PATENT DOCUMENTS

| | | | | |
|---|---|---|---|---|
| 81456 | * | 6/1983 | (EP) | 415/206 |
| 676564 | * | 2/1930 | (FR) | 415/204 |

* cited by examiner

*Primary Examiner*—Edward K. Look
*Assistant Examiner*—Liam McDowell
(74) *Attorney, Agent, or Firm*—Fay, Sharpe, Fagan, Minnich & McKee, LLP

(57) ABSTRACT

An impeller housing for a suction device with reduced noise and improved airflow. The impeller assembly comprises a shaft and a housing. The housing comprises a volute, a central axis, and an inlet port located along the central axis. An outlet port is located on a second axis spaced from the central axis. An exhaust passage extends from the outlet port. An impeller is mounted on the shaft for rotation. The impeller comprises a hub, and at least one blade extending from the hub. The blade has a distal surface spaced from the shaft. The impeller housing has a first plane which is approximately perpendicular to the central axis. The first plane contacts the blade distal surface. A second plane is parallel to and spaced apart from the first plane. The second plane contacts a wall of the outlet port at a location closest to the first plane. The exhaust passage can increase in diameter along its length. The outlet port can be of a circular cross-section. A spacing wall is positioned between the volute and the wall of the outlet port and spaces each blade from the outlet port, thus reducing noise and increasing airflow.

21 Claims, 11 Drawing Sheets

IMPELLER HOUSING WITH REDUCED NOISE AND IMPROVED AIRFLOW

BACKGROUND OF THE INVENTION

The present invention relates to an impeller housing for a suction device. More particularly, it relates to an improved impeller housing which has reduced noise and improved airflow.

In a "dirty air" vacuum cleaner, the debris passes directly through the vacuum impeller chamber prior to being captured by the cleaner bag. In contrast, a "clean air" vacuum cleaner has the motor drawing the air and debris through the bag so that the bag captures the debris. The air only subsequently passes through the impeller chamber. The dirt path in a dirty air vacuum cleaner is very short compared to most clean air systems, which has advantages for cleaning performance. One disadvantage of dirty air motors is that they are typically louder than clean air motors. They also have a very loud tone noise. While not the largest contributor to the overall noise levels, the tone noise can be very annoying to consumers.

Tone noise typically occurs at a frequency that is seven times the rotation rate of the motor, which corresponds to the seven blades of the typical working fan. The motor cooling fan typically has twelve blades, is small, and may not, therefore, be a source of additional tone noise as was the case in the particular motor studied. The working fan blades cause the tone noise when they pass a geometric discontinuity in the volute shape. For example, FIG. 1 shows a cross section of the volute with the fan blades of an existing design. FIG. 1 also shows a geometric discontinuity at the motor outlet that causes tone noise. There is usually no geometric discontinuity at the motor inlet. Such discontinuities cause noise by interacting with the airflow leaving the ends of the blades. The airflow leaving the end of the blades is chopped by the discontinuities at the rate that the blades pass these discontinuities.

For noise control, there are two primary solutions. One is to isolate the noise source so that it is not heard; the other is to reduce the noise source. Isolating the noise source is an expensive choice. However, it does not require a good understanding of the noise source mechanism to be effective. The preferred solution is to reduce the source of noise.

Reducing the interaction of the airflow from the blade ends with the volute exhaust opening reduces the source of tone noise. Several ways to accomplish this are a) increasing the distance between the outer wall of the volute and the fan blade tips, b) reducing the fan rotation rate to reduce air velocity off the fan blade tips, and c) eliminating the geometric discontinuities, by moving the exhaust opening below the volute or on a different plane from the volute so that the fan blades are enclosed in a constant cross-section volute.

The first option, increasing the distance between the outer wall of the volute and the fan blade tips, has been used in several designs, but with limited success.

The second option, reducing the air velocity, reduces the noise level by approximately the velocity cubed. Reducing the air velocity would be accomplished by reducing the rpm of the motor or reducing the size of the working fan while maintaining the motor speed. Care must be taken when just reducing the size of the working fan because the motor would speed up due to the reduced load, which can result in the same velocities. If this solution were implemented, then the broadband noise would also be reduced because the broadband noise due to air turbulence decreases as the velocity decreases. However, reducing the fan rotation rate to reduce air velocity off the fan blade tips is not considered feasible because the current trend of U.S. vacuum cleaners has been to obtain as large an electrical amperage rating as possible.

Therefore, the third option, eliminating geometric discontinuities by moving the exhaust opening to below the volute or to a different plane from the volute, is the most feasible solution.

This option reduces the tone noise by removing the source of the noise. The goal is for the space around the fan tips to be in the shape of a uniform ring. Space is then provided for the air to exit behind the fan.

Accordingly, it has been considered desirable to develop a new and improved impeller housing which would overcome the foregoing difficulties and others and meet the above stated needs while providing better and more advantageous overall results.

SUMMARY OF THE INVENTION

The present invention relates to an impeller housing for a suction device. More particularly, it relates to an impeller assembly with an improved housing which has reduced noise and improved airflow.

The impeller assembly comprises a shaft and a housing. The housing comprises a plurality of walls. One of the walls comprises a volute. The plurality of walls can comprise a first wall, a second wall, a side wall connecting the first wall to the second wall, and a third wall extending from the first wall. The housing further includes a central axis, and an inlet port located along the central axis. The third wall forms an inlet passage extending from the inlet port. The shaft extends into the housing through the inlet port. The shaft is mounted along the central axis.

An outlet port is located on a second axis spaced from the central axis. An exhaust passage extends from the outlet port. The exhaust passage can increase in diameter along its length. The outlet port can be of a circular cross-section.

An impeller is mounted on the shaft for rotation. The impeller is located in the housing. The impeller includes a hub, and at least one blade extending from the hub. Each blade has a distal surface spaced from the shaft.

The impeller assembly further comprises a first plane which is approximately perpendicular to the central axis. The first plane contacts each blade distal surface. The impeller assembly also includes a second plane, parallel to and spaced apart from the first plane. The second plane contacts a wall of the outlet port at a location closest to the first plane.

The impeller blade can comprise a leading edge, a top edge and a trailing edge. The impeller can further comprise a backplate which supports the at least one blade. The backplate is positioned along the first plane.

A spacing wall is positioned between the volute and the wall of the outlet port to space each blade from the outlet port.

A top surface of the impeller can be generally parallel to a top surface of the impeller housing and the area between the top surface of the impeller and the top surface of the housing is minimized to reduce noise.

The impeller housing can include a first section and a second section to form a two-piece housing.

One advantage of the present invention is the provision of a suction device having a new and improved impeller housing.

Another advantage of the present invention is the provision of an impeller housing with an exhaust passage which increases in diameter along its length.

Still another advantage of the present invention is the provision of an impeller housing accommodating an impeller. At least one blade of the impeller is located on a plane spaced from the plane of an outlet port of the impeller housing, thus reducing noise.

Yet another advantage of the present invention is the provision of an impeller housing in which the area between an upper surface of the impeller and an adjacent surface of the impeller housing is minimized to reduce noise.

Still yet another advantage of the present invention is the provision of an impeller housing with a spacing wall which is positioned between a volute of the housing and the wall of an outlet port of the housing to space each impeller blade from the outlet port thus reducing noise.

Still other benefits and advantages of the present invention will become apparent to those skilled in the art upon a reading and understanding of the following detailed specification.

BRIEF DESCRIPTION OF THE DRAWINGS

The invention may take form in certain parts and arrangements of parts, preferred embodiments of which will be described in detail in this specification and illustrated in the accompanying drawings which form a part hereof and wherein.

DETAILED DESCRIPTION OF THE PREFERRED EMBODIMENTS

Figure 1:
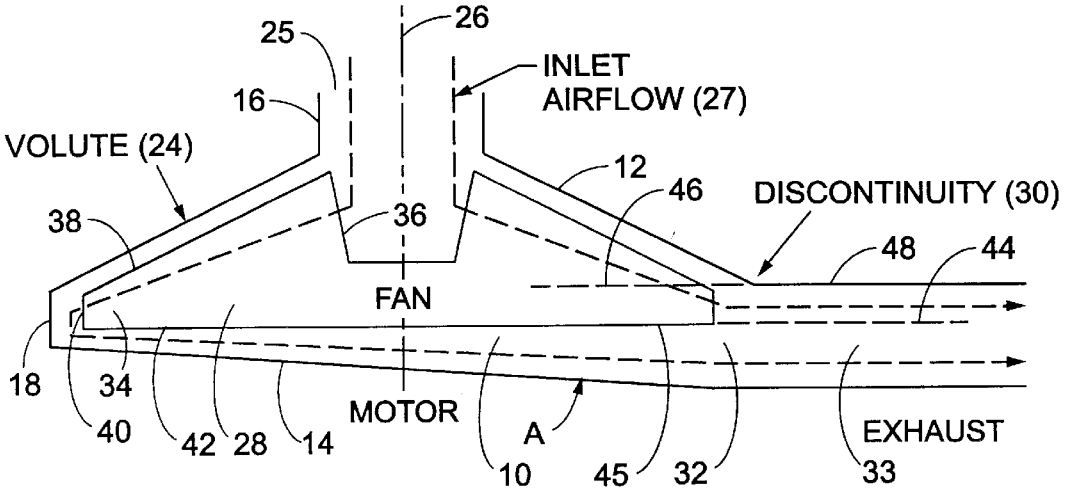
FIG. 1 PRIOR ART
FIG. 1 is a schematic side elevational view in cross-section of a prior art impeller housing having a discontinuity.

Referring now to the drawings, wherein the showings are for purposes of illustrating preferred embodiments of this invention only, and not for purposes of limiting same, FIG. 1 shows a schematic cross section of a known impeller housing and its fan blades. To eliminate the geometric discontinuity in this known design, the exhaust opening must be moved below the fan blades or on a different plane from the fan blades. The resulting airflow would then be similar to a clean air motor where the air flows off the end of the fan blades into a volume below the fan. The air is then collected in a channel and exhausted.

More specifically, referring to FIG. 1, the known impeller assembly A comprises a housing 10 which has a first wall 12, a second wall 14, a third wall 16, and a side wall 18 which connects the first wall 12 to the second wall 14. The first wall 12 forms a volute 24.

The third wall 16 extends away from the first wall 12. The third wall 16 forms the inlet passage of the volute and defines an inlet port 25. The housing 10 further comprises a central axis 26. The inlet port 25 is located along the central axis 26.

Inlet airflow 27 enters the housing through the inlet port 25. The inlet airflow 27 then is moved by a rotating impeller 28 and passes over a discontinuity 30 formed in the first wall 12 to an outlet port 32. An exhaust passage 33 extends away from the outlet port 32.

The air passes over at least one blade 34 of the impeller 28. The blade 34 has a leading edge 36, a top edge 38, and a trailing edge 40. The inlet airflow 27 passes by the leading edge 36, and between the blades 34 past the trailing edge 40 of the blades 34. The airflow 27 then is expelled into the outlet port 32 and through the exhaust passage 33. The impeller 28 further comprises a backplate 42 which supports the set of blades 34. The backplate 42 is positioned along a first plane 44 which is approximately perpendicular to the central axis 26.

The first plane 44 contacts a distal surface 45 of each blade 34. A second plane 46 is parallel to and spaced from the first plane 44. The second plane 46 contacts a wall 48 of the outlet port 32. The first plane 44 extends into the outlet port 32 such that the blade distal surface 45 is positioned below the outlet port wall 48. That is, the blade distal surface is in the plane of the outlet port 32 opening. Thus, since the blade 34 is aligned with the outlet port 32 opening, the airflow passes from the end of the blades through the discontinuity 30. The airflow is then chopped by the discontinuity 30 at the rate that the set of blades 34 pass the discontinuity 30, thus causing noise.

Figure 2:
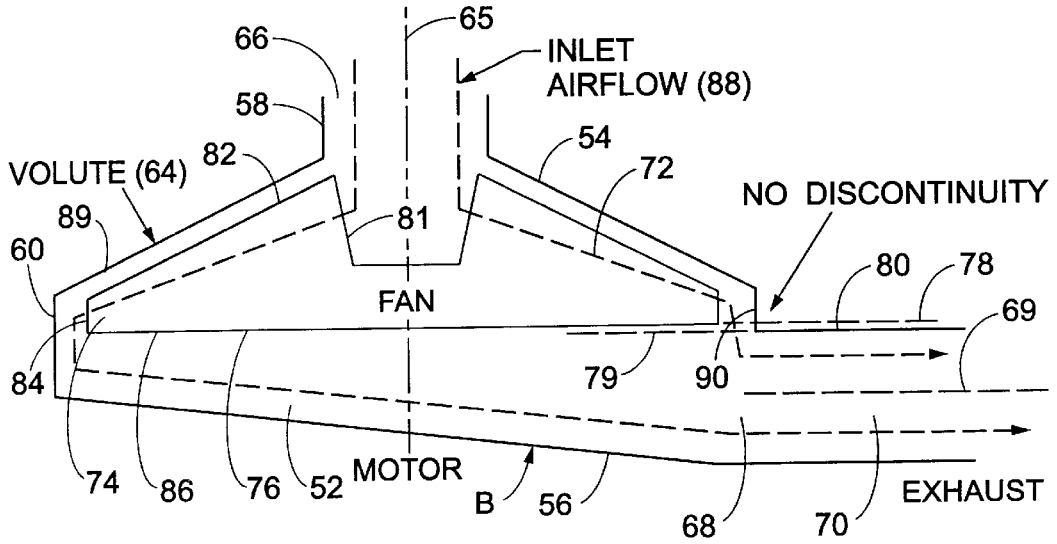
FIG. 2 is a schematic side elevational view in cross-section of an impeller housing in accordance with a first preferred embodiment of the present invention.

With reference now to FIG. 2, an impeller assembly B with an improved impeller housing which eliminates a discontinuity is shown. The impeller assembly B comprises a shaft 50 (shown in FIG. 3) and a housing 52. The housing 52 comprises a first wall 54, a second wall 56, a third wall 58 and a side wall 60. The side wall 60 connects the first wall 54 to the second wall 56. The third wall 58 extends away from the first wall 54. The first wall 54 forms a volute 64.

The impeller housing also comprises a central axis 65. An inlet port 66 is located along the central axis 65.

The third wall 58 forms the inlet passage and defines the inlet port 66. The shaft 50 extends into the housing 52 through the inlet port 66. The shaft 50 is mounted along the central axis 65.

Figure 4:
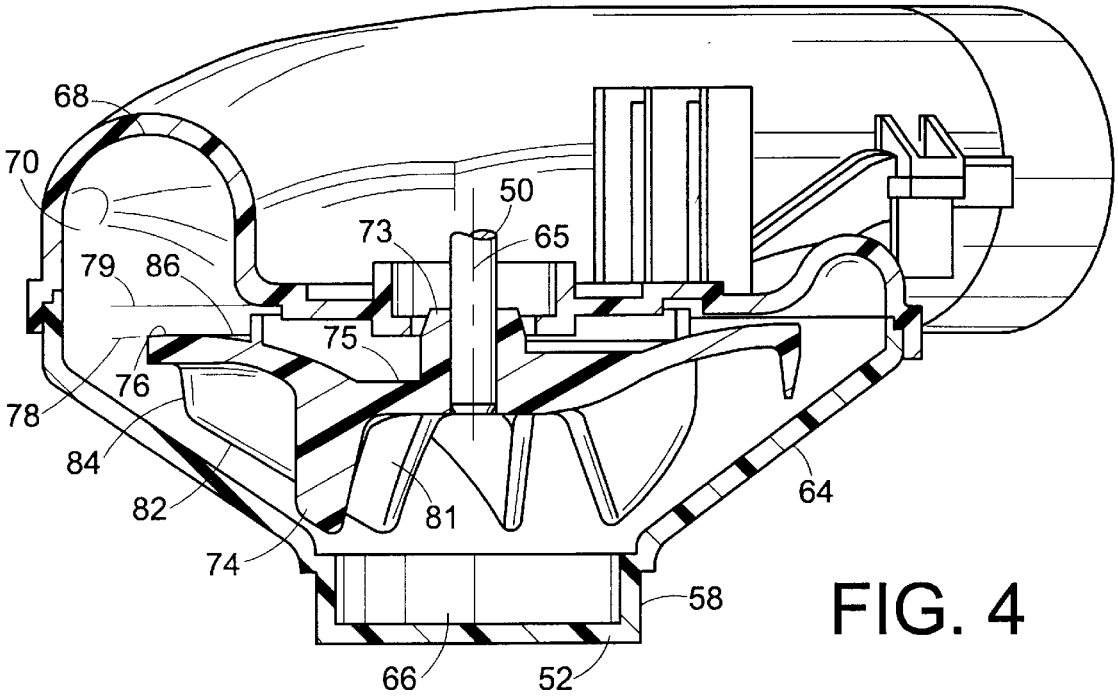
FIG. 4 is a cross-sectional view of the impeller housing of FIG. 3 along line 4—4.
Figure 5:
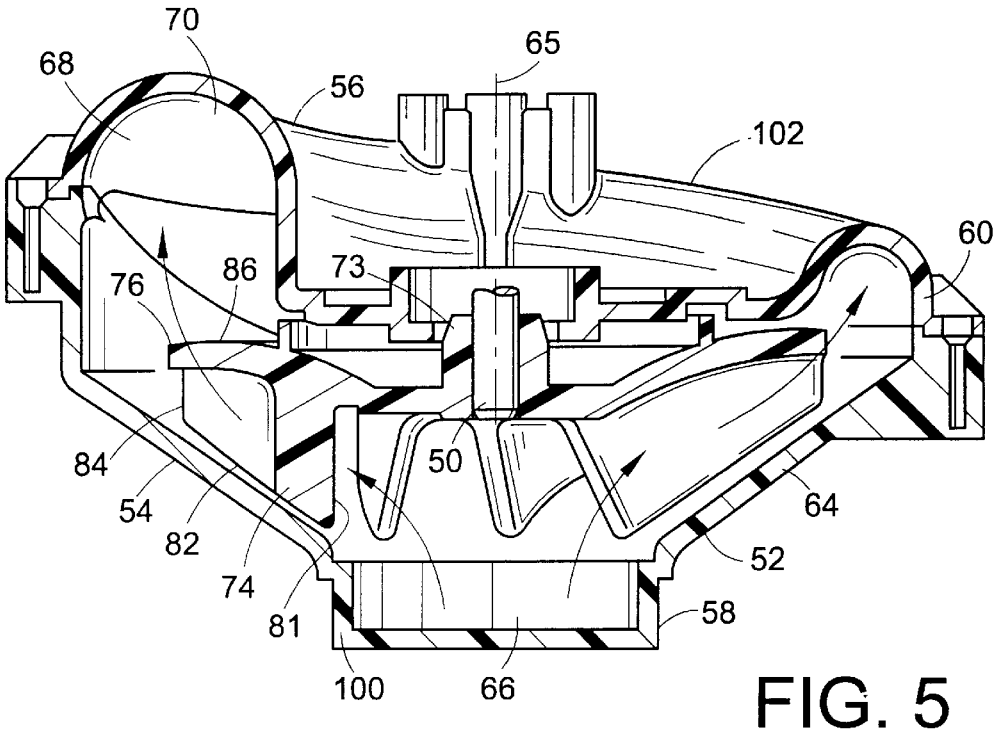
FIG. 5 is a cross-sectional view of the impeller housing of FIG. 3 along line 5—5.
Figure 6:
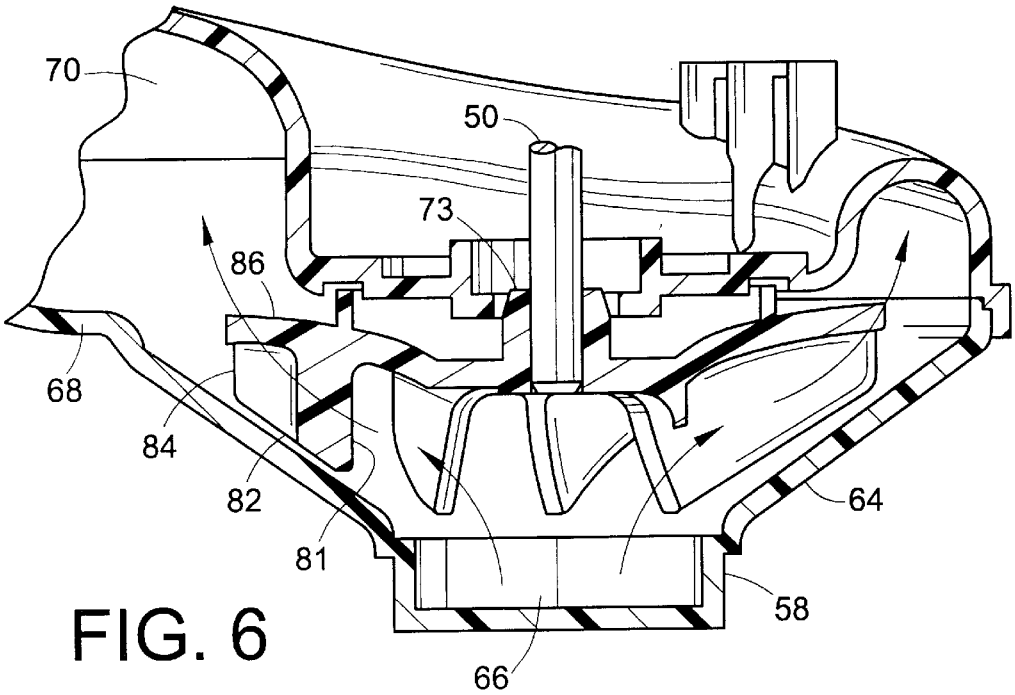
FIG. 6 is a cross-sectional view of the impeller housing of FIG. 3 along line 6—6.
Figure 7:
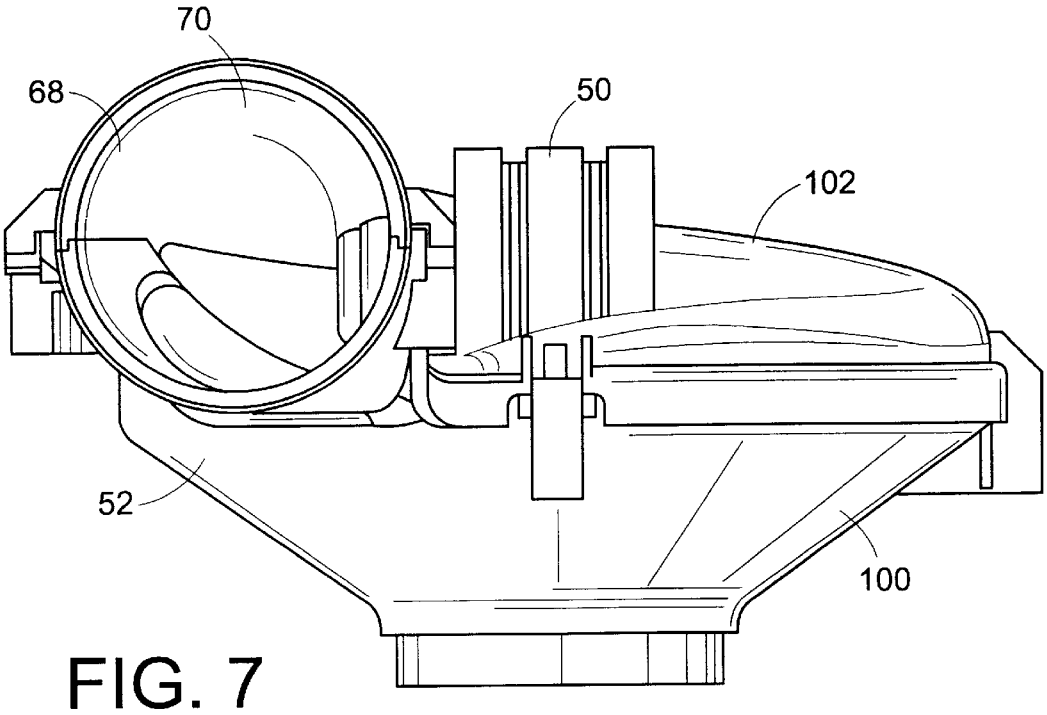
FIG. 7 is a side elevational view of the impeller housing of FIG. 3.

An outlet port 68 is located on a second axis 69 spaced from and approximately normal to the central axis 65. An exhaust passage 70 extends away from the outlet port 68. If desired, the exhaust passage 70 can increase in diameter along its length. The exhaust passage 70 can be enlarged to handle an increased air flow. FIGS. 4, 5 and 6 show the exhaust passage 70 diameter increasing along the passage length at different cross sections of the exhaust passage 70. Referring to FIG. 7, the outlet port 68 can be of a circular cross section in lieu of a rectangular cross section which is used in existing impeller housings.

Referring again to FIG. 2, an impeller 72 is mounted on the shaft 50 for rotation. The impeller 72, which is located within the housing 52, comprises a hub 73 (shown in FIGS. 4, 5, and 6) and at least one blade 74 which extends from the hub 73 along a flange 75. Preferably, a plurality of blades are used. Each blade 74 has a distal surface 76 which is spaced from the shaft 50.

The volute 64 can have a uniform cross section. Each blade 74 is enclosed within the cross section of the volute 64. The uniform cross section of the volute 64 helps to reduce noise by eliminating discontinuity along the blade length.

The impeller assembly further comprises a first plane 78 which is approximately perpendicular to the central axis 65. The first plane 78 contacts the blade distal surface 76.

The impeller assembly also comprises a second plane 79 which is parallel to and spaced from the first plane 78. The second plane 79 contacts a wall 80 of the outlet port 68 at a location which is closest to the first plane 78.

The blade 74 comprises a leading edge 81, a top edge 82, and a trailing edge 84. A backplate 86, which supports the blade 74, is positioned along the first plane 78.

Preferably, the top edge 82 of the impeller is generally parallel to a top surface 89 of the impeller housing. The area between them is preferably minimized to further reduce noise.

The impeller 72 creates an air flow (illustrated by dotted line 88 in FIG. 2) drawing air through the inlet port 66. The airflow 88 passes by the leading edge 81, and between the blades 74 past the trailing edge 84 of the blades 74. The airflow 88 then is expelled through the outlet port 68 and into the exhaust passage 70 during rotation of the impeller 72.

The impeller assembly also comprises a spacer wall 90 which is positioned between the volute 64 and the wall 80 of the outlet port 68. The spacer wall 90 spaces the trailing edge 84 of each blade 74 from the outlet port 68 and helps eliminate any discontinuity between the volute 64 and the outlet port 68.

Figure 3:
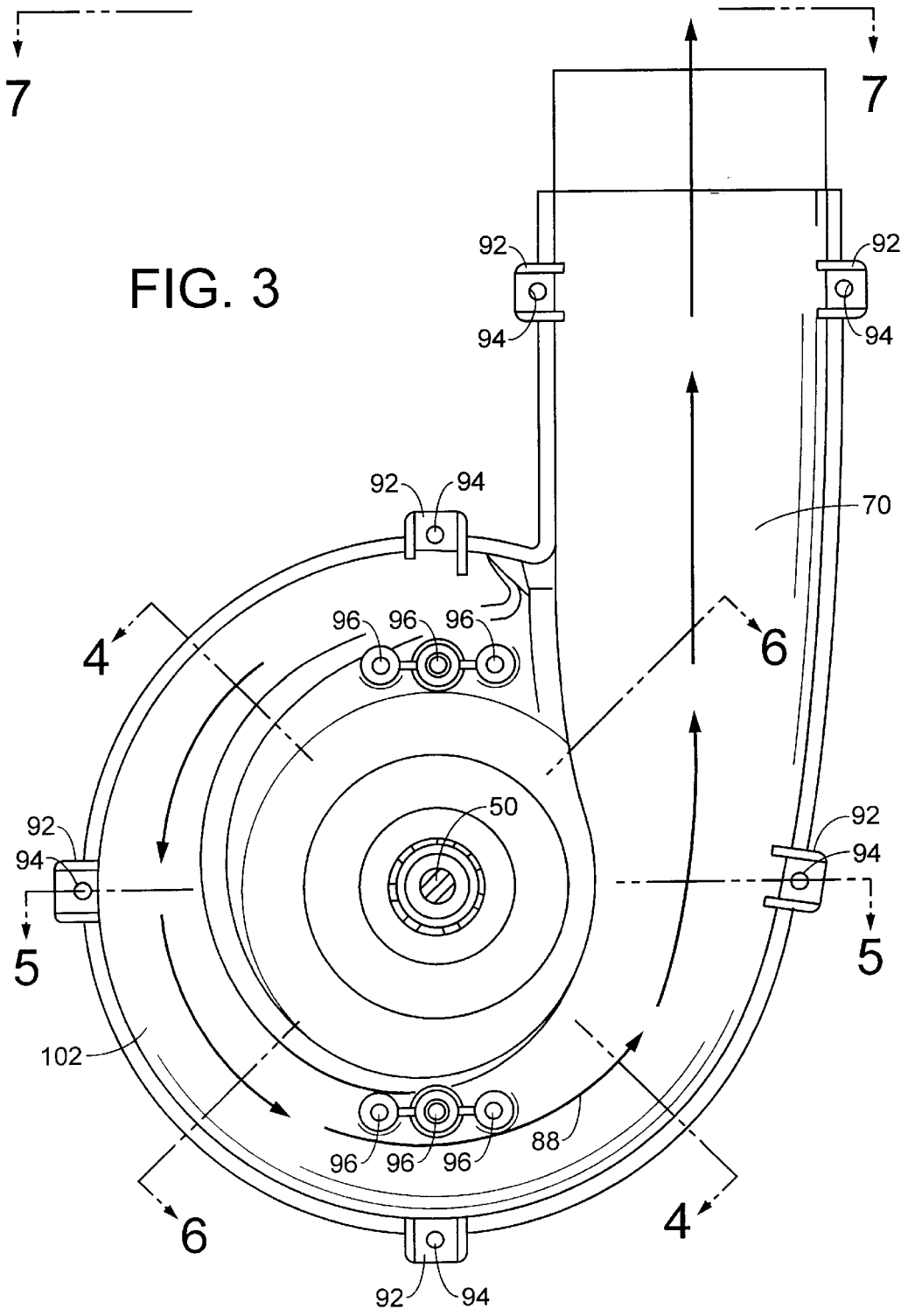
FIG. 3 is a top plan view of a prototype impeller housing according to the first preferred embodiment of FIG. 2.

Referring to FIGS. 3 and 7, in one preferred embodiment, the impeller assembly comprises a two-piece housing including a first section 100 and a second section 102. Referring to FIG. 3, the first section 100 and second section 102 each have one or more aligned flanges 92. The flanges 92 are spaced from each other. The flanges 92 each have aligned holes 94 for mounting the first section 100 to the second section 102. Additional holes 96 can also be provided for mounting the housing to the body of a vacuum cleaner or similar suction device.

Referring to FIG. 5, the first section 100 comprises the first and third walls 54, 58, a portion of the side wall 60, the inlet port 66 and a portion of the outlet port 68. The second section 102 comprises the remaining portion of the side wall 60, the second wall 56, and the remaining portion of the outlet port 68.

Another means to reduce noise created by an impeller is to reduce the rotation rate of the motor. In order to maintain the same airflow, the diameter of the impeller and the efficiency of the volute to deliver the air to the fan must be increased. Therefore, the impeller diameter has been increased by approximately 6%, the inlet area by approximately 12%, and the exhaust area by approximately 38% compared to the existing design.

The housing illustrated in FIGS. 3–7 was evaluated in a series of tests. But first, the noise radiated by the motors alone and the air performance was measured. The old motor was operated at approximately 24,000 rpm and the new motor was operated at approximately 22,500 rpm.

Figure 8:
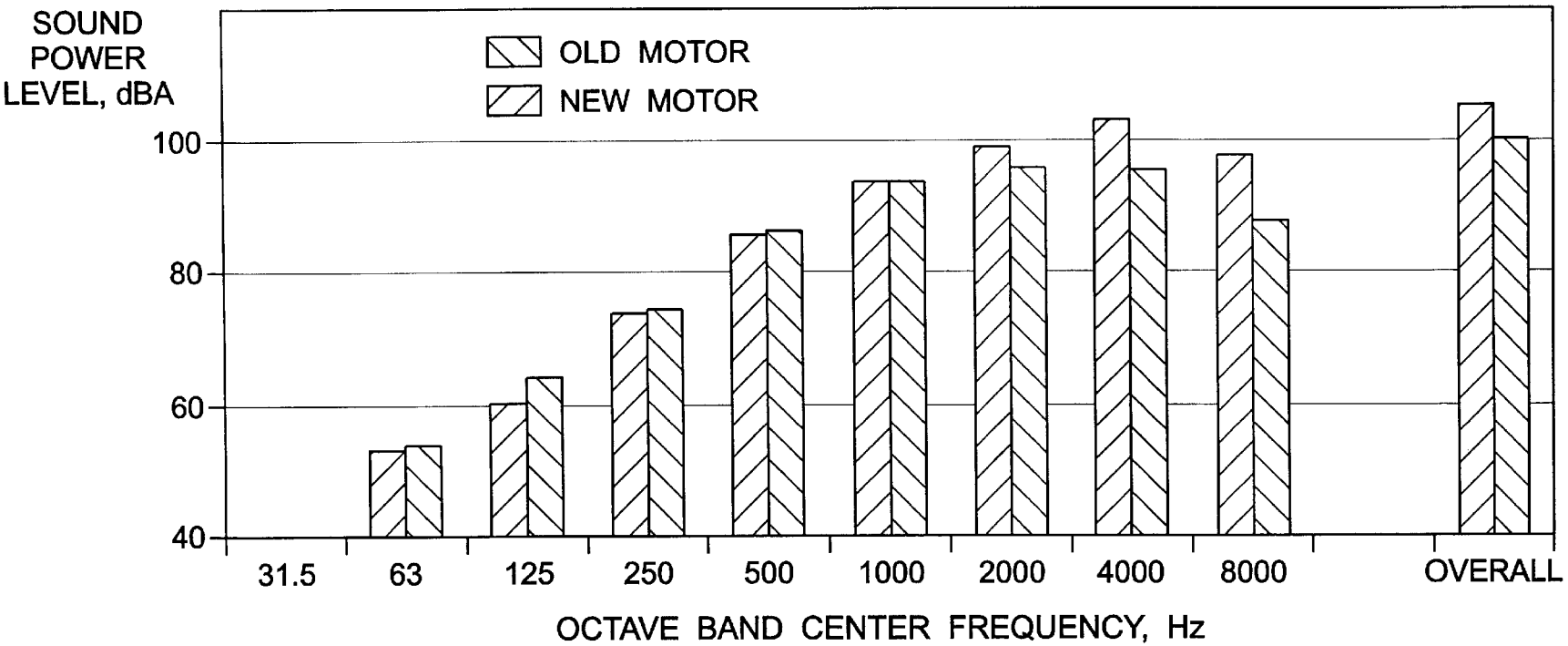
FIG. 8 is a chart comparing sound power level to octave band center frequency for the old motor in the impeller housing of FIG. 1 and new motor in the impeller housing of FIG. 2.

Then the respective motors were placed in the known impeller housing of FIG. 1 and the inventive impeller housing of FIGS. 3–7. The A-weighted octave band and overall sound power levels of the old and new motors and volutes alone in comparison with octave band center frequency are shown in FIG. 8. The average sound spectra of the two volute designs are shown in FIG. 9.

Figure 9:
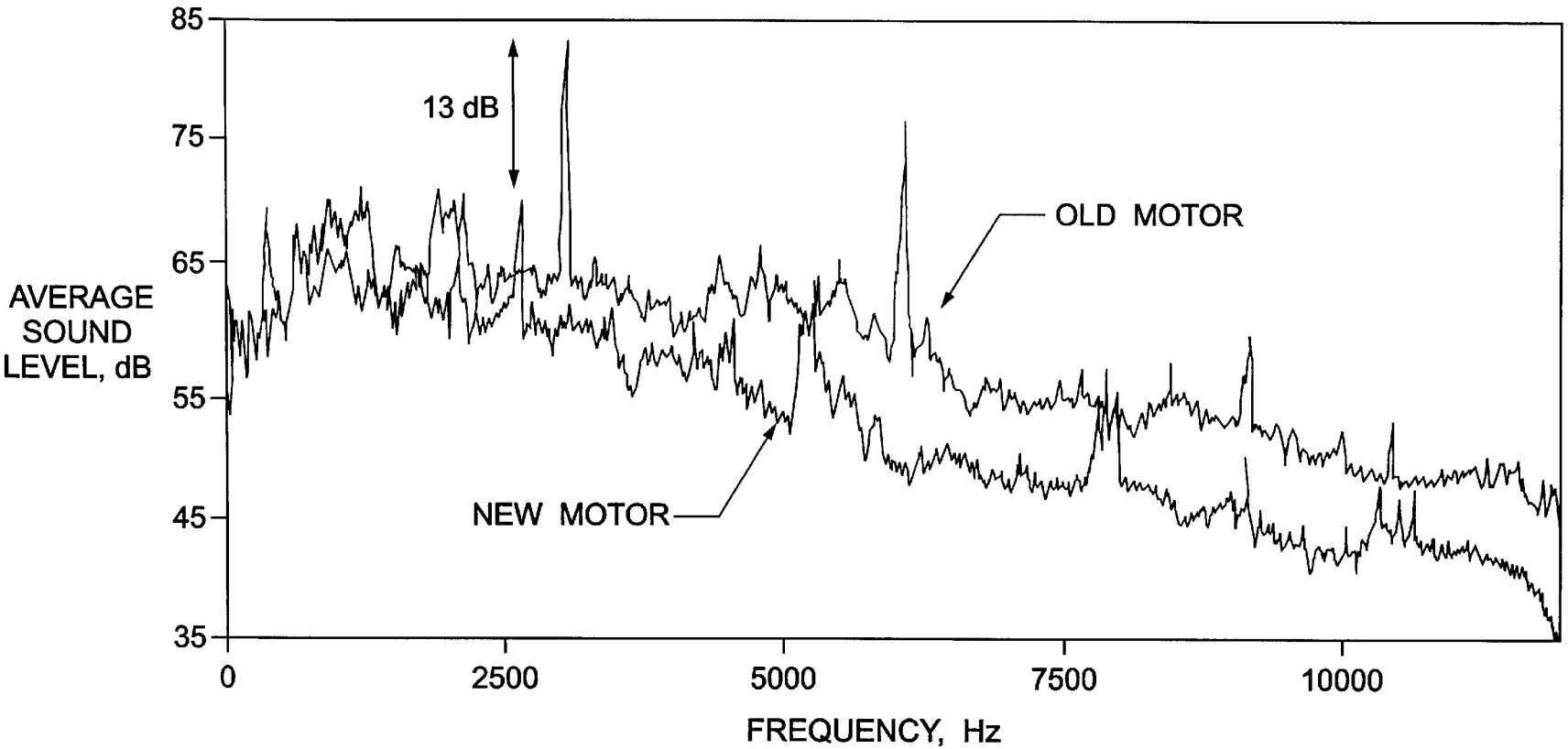
FIG. 9 is a chart comparing average sound level to frequency for the old motor and the new motor.

Referring to FIGS. 8 and 9, the new motor and impeller housing design creates broadband and tone noise reduction. The overall noise reduction is 5.5 dBA. The 2000 Hz, 4000 Hz, and 8000 Hz octave bands are all reduced. The broadband noise reduction and the 13 dB reduction in the fundamental tone are seen in FIG. 9. Only the noise in the low octave bands, 500 Hz and below, is increased with the new motor and impeller housing design. These octave bands are low compared to the octave bands where significant noise reduction was found, so these increases are not significant for the overall sound power level.

Tone noise reduction was expected with the new volute design, but broadband noise reduction was not expected. Broadband noise is generally caused by turbulence. Therefore, the new volute design allows air to flow through the volute with less turbulence. Since turbulence also decreases the efficiency of the fan, this reduction should also be reflected in the air performance.

Figure 10:
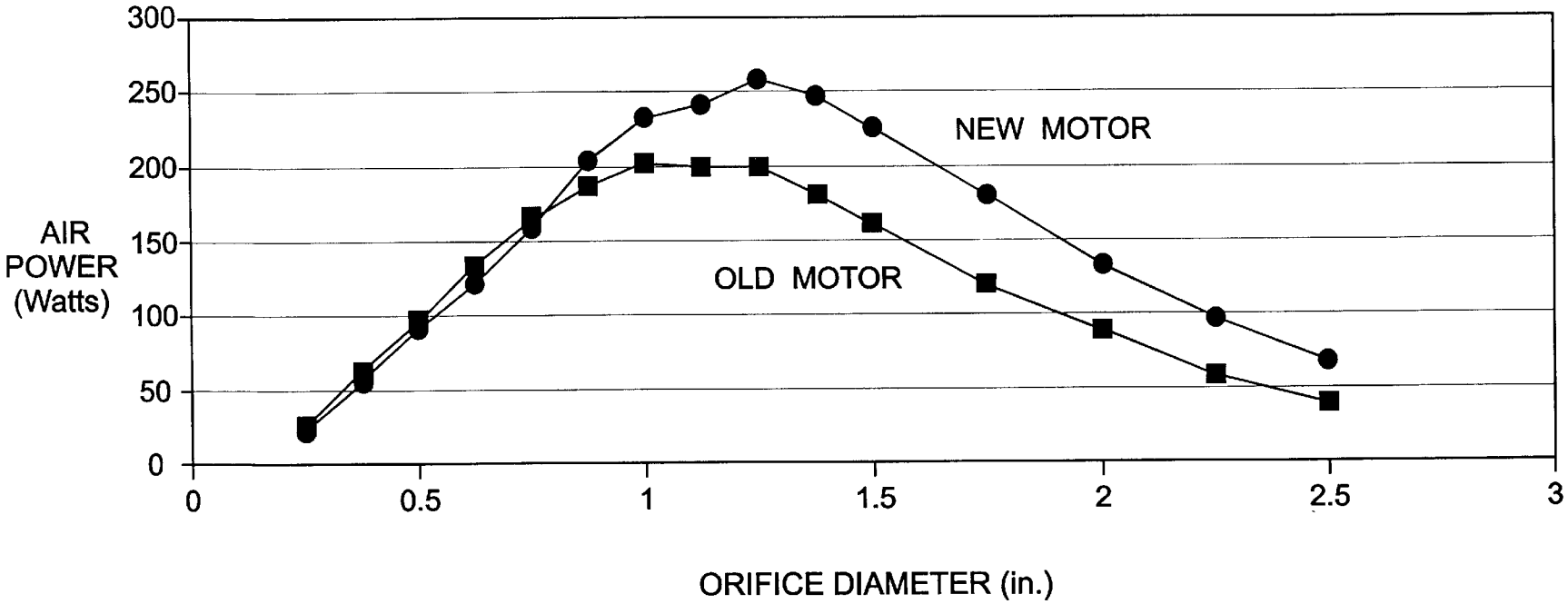
FIG. 10 is a chart comparing air power to orifice diameter for the old motor and the new motor.

The air power delivered by the new and old motor and impeller housing designs alone in comparison to the orifice diameter is shown in FIG. 10. Only the air power is shown because it is a good summary of the air performance and similar differences are seen in all the air performance parameters. The air power delivered by the new design has a peak that occurs at a larger orifice than the old design and the peak power increases by approximately 27%. This occurs with an approximate 6% rotation rate reduction.

The broadband noise reduction would initially appear to be a result of the volute and impeller moving less air. However, the increased air power along with the reduced broadband noise indicates that the new volute and fan are able to deliver more air because of a significant decrease in turbulence. Thus, turbulence, which decreases the efficiency for the motor to deliver air, is also a cause of noise. Therefore, improving airflow can be coupled with noise reduction because the noise causing mechanism is often also degrading performance.

During testing, an earlier version of the motor modification was placed inside a full vacuum cleaner. The noise reduction caused by the new motor and impeller housing design decreased from 7.8 dBA with the motor alone to 1.4 dBA overall in the vacuum cleaner. The tone noise reduction reduced from 10.7 dB with the motor and impeller housing alone to 5.7 dB in the vacuum cleaner. The measurements were performed without the brushroll operating, so the variation in noise reduction was due to the changes in airflow in the unit with and without the motor and impeller housing modification. The decreased noise reduction with the new motor and impeller housing in the vacuum cleaner indicates that the air path in the vacuum cleaner significantly negated the noise reduction that was obtained with the motor and impeller housing alone.

One hypothesis was that the lower noise reduction was caused by the back pressure on the motor created by the exhaust air path from the motor through the bag of the vacuum cleaner. This back pressure caused the air turbulence from the fan blades to interact with the volute exhaust despite the new volute geometry. Therefore, the air delivery system in the vacuum cleaner had to be redesigned to obtain the same amount of noise reduction as obtained by the motor and housing alone.

A new air delivery system was designed which allowed a greater airflow to match the increased airflow delivered by the new motor. The design steps focused on reducing the head losses throughout the air delivery system. The duct geometry, sharp bends, and the geometry of the bag cover caused significant head losses. Changes were made to the air delivery system and implemented on a prototype. To date, the prototype was constructed to test the air performance of the new air delivery system.

Figure 11:
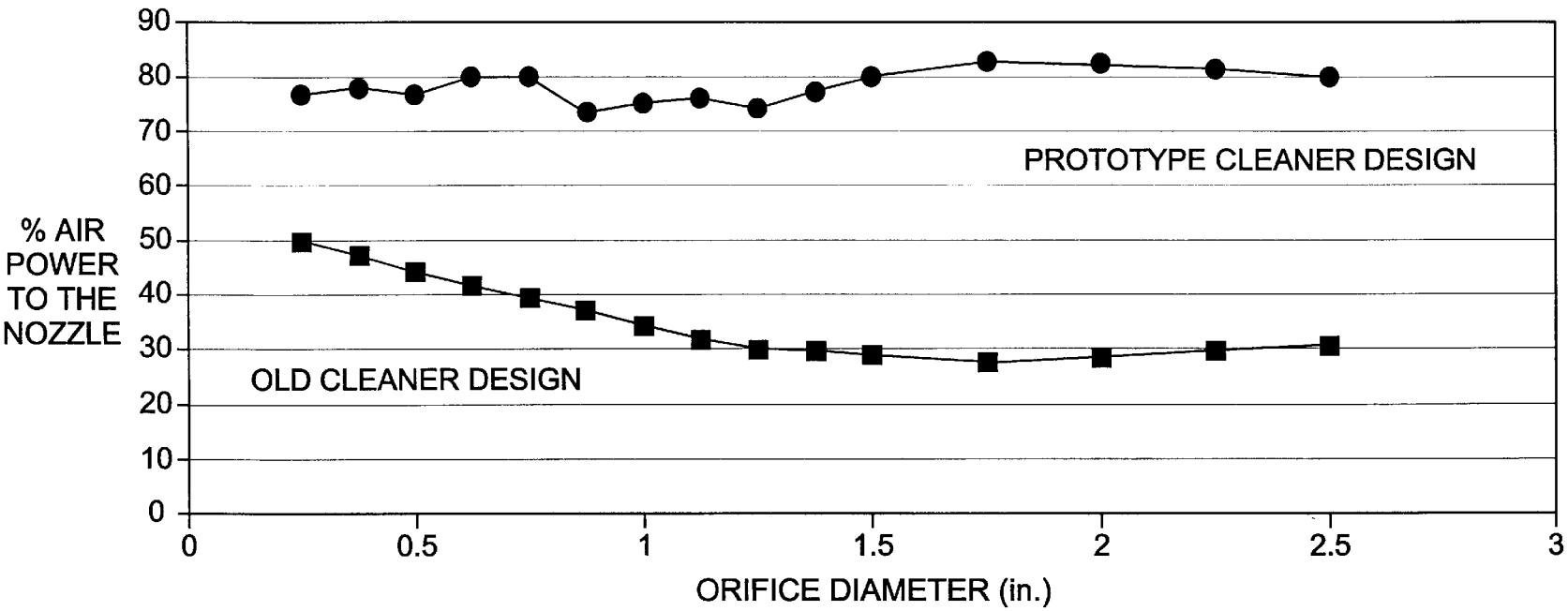
FIG. 11 is a chart comparing percent air power to a nozzle and orifice diameter for an old cleaner design and the prototype cleaner design of FIG. 3.

FIG. 11 shows a comparison of the percentage of air power delivered to the floor by the old vacuum cleaner of FIG. 1 and the prototype cleaner employing the motor and housing assembly of FIGS. 3–7. The data represents the air power at the floor with the full unit compared to the air power delivered by the motor alone. With the new air delivery system, the prototype delivers approximately 80% of the air power at the motor to the floor, compared to 35% to 40% by the old design. This significant increase in efficiency results in a lower back pressure on the new motor. The tone noise reduction is still present on the prototype.

One of the primary conclusions is that the mechanism which causes noise in the fan and volute also degrades the air performance. Thus, by removing the exhaust from the path of the fan blade tips both noise reduction and increased air performance can be obtained simultaneously. The improved impeller housing discussed above and shown in FIGS. 2–7 solves the problem by eliminating any geometric discontinuity by moving the exhaust opening to a plane spaced from the plane of the volute and the impeller.

Figure 12:
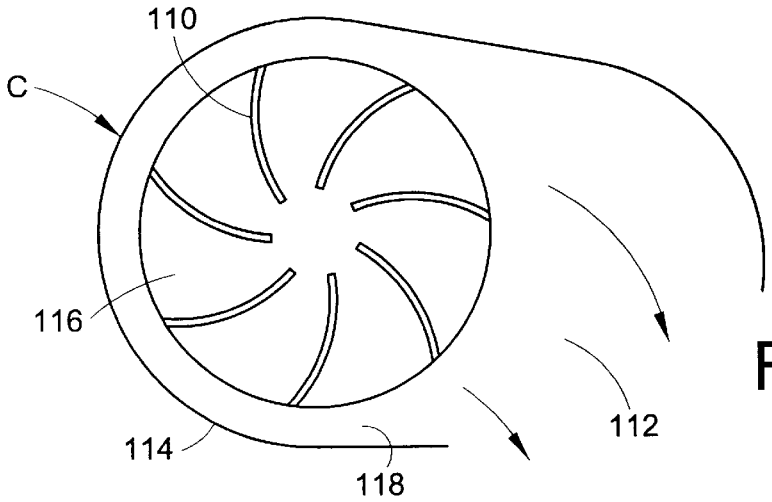
FIG. 12 PRIOR ART
FIG. 12 is a schematic top plan view of another prior art impeller housing.

FIG. 12 shows a prior art impeller assembly C for a carpet extractor. The primary noise problem with the prior art impeller assembly is a loud tone noise. This is caused by air leaving the tip of an impeller blade 110 and being chopped by an opening 112 in a volute 114 which encloses an impeller 116. The chopping occurs when the blade 110 passes an opening edge or discontinuity 118, thus causing the tone noise at the rotation rate of the impeller 116 times the number of blades 110.

Figure 13:
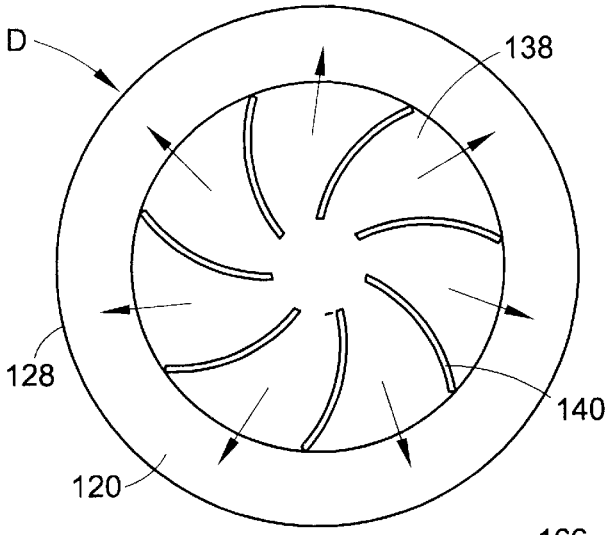
FIG. 13 is a schematic top plan view of an impeller housing in accordance with a second preferred embodiment of the present invention.

A second preferred embodiment of the present invention is shown in FIG. 13 in the form of an impeller assembly D. This design eliminates any discontinuity, thus reducing tone noise. The impeller assembly D comprises a housing 120. The housing 120 comprises a first wall 122, a second wall 124, and a side wall 126. The side wall 126 connects the first wall 122 to the second wall 124. The first wall 122 forms a volute 128.

The impeller housing comprises a central axis 130. An inlet port 132 is located along the central axis 130. An outlet port 134 is located on a second axis 136 spaced from, and approximately normal to, the central axis 130. An impeller 138 is mounted within the housing 120. The impeller comprises at least one blade 140. The impeller 138 creates an airflow (illustrated by line 142) drawing air through the inlet port 132. The airflow 142 passes through the blades 140 past a trailing edge 141 of the blades 140. The airflow 142 is expelled through the outlet port 134.

The impeller assembly also comprises a spacer wall 144 which is positioned between the volute 128 and a wall 146 of the outlet port 134. The spacer wall 144 spaces the blade 140 from the outlet port 134 and helps eliminate any discontinuity between the volute 128 and the outlet port 134.

Figure 14:
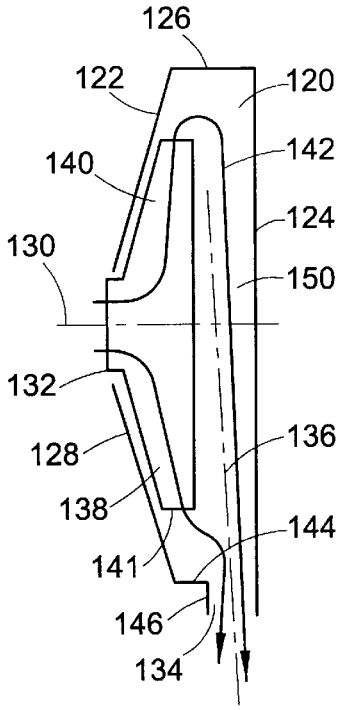
FIG. 14 is a schematic side elevational view in cross-section of the proposed impeller housing of FIG. 13.

Thus, the improved impeller assembly D reduces the tone noise by removing the source of the noise. This is accomplished by providing a space around the impeller blades 140 which is in the shape of a uniform ring. As shown in FIG. 13, the volute 128 forms the uniform ring around the impeller 138. Referring to FIG. 14, the air exhausts to an area 150 below the impeller 138 then out of the volute 128 through the outlet port 134. There is no discontinuity at the outlet port as is shown in FIG. 12 for the prior art housing (edge 118).

Figure 15:
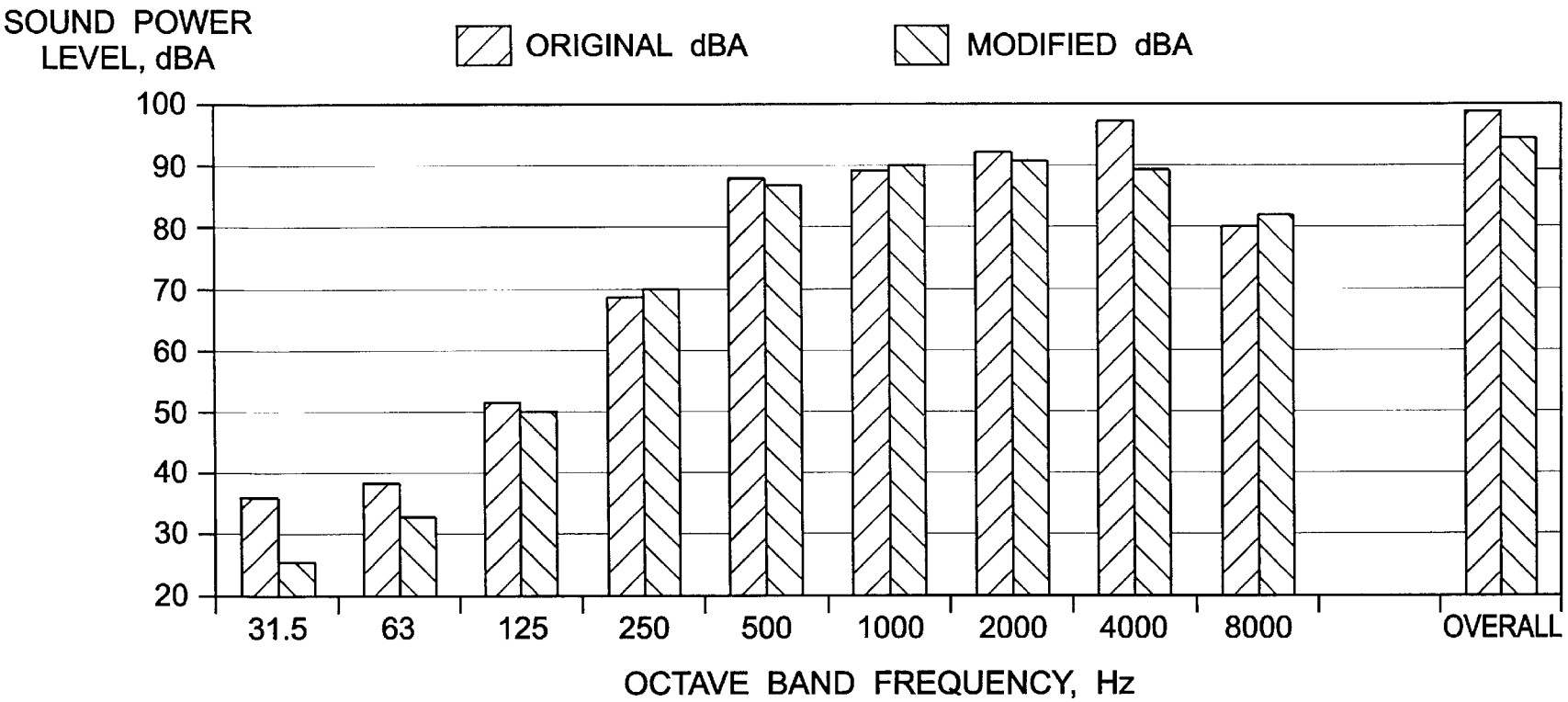
FIG. 15 is a chart comparing sound power loudness against octave band frequency of the FIG. 12 design and the FIG. 13 design.

FIG. 15 shows the sound power levels of the old motor and volute assembly of FIG. 12 and the improved motor and volute assembly of FIGS. 13 and 14 in comparison with octave band frequency. The sound power of the impeller was measured according to the ASTM F1334-97 test method. In all the measurements, a one-quarter inch ACO Pacific type 4012 microphone was used. The signal from the microphone was amplified by a Rockland series 2000 low-pass filter. The amplified signal was input to a National Instruments model AT-A2150C data acquisition card installed in a PC computer. The data acquisition was controlled with a Labview program, which output the measured sound pressure spectrum. The octave band and overall sound power levels were calculated from the sound pressure spectra.

The air performance was measured with an automated plenum chamber operated according to the ASTM F558-95 test procedure. The measured parameter was the pressure inside the plenum from which the airflow volume velocity and the air power were calculated. Measurements were made with several inlet orifice diameters for the plenum chamber. Thus, the volume, velocity and suction were output as a function of inlet orifice.

Figure 16:
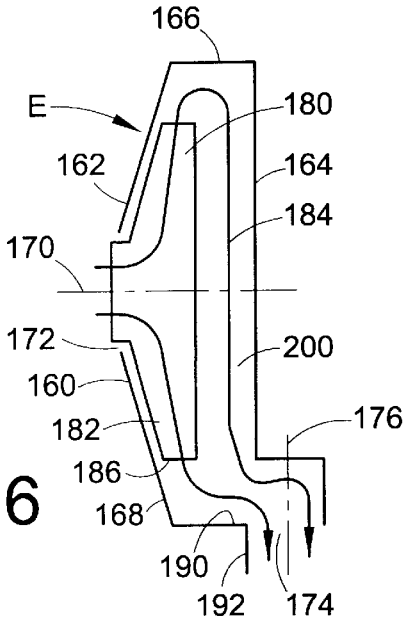
FIG. 16 is a schematic side elevational view in cross-section of an impeller housing as implemented in a prototype according to a third preferred embodiment of the present invention.

A third preferred embodiment of the present invention is shown in FIG. 16. FIG. 16 shows the implementation of the noise reduction solution in a prototype impeller assembly E for a carpet extractor. In the prototype, the brushroll motor and the pump of the carpet extractor were removed to allow room for the lower portion of the impeller housing. Airflow was reduced due to a smaller exhaust area. Referring to FIG. 16, the impeller assembly E comprises a housing 160. The housing 160 comprises a first wall 162, a second wall 164, and a side wall 166. The side wall 166 connects the first wall 162 to the second wall 164. The first wall 162 forms a volute 168.

The impeller housing comprises a central axis 170. An inlet port 172 is located along the central axis 170. An outlet port 174 is located on a second axis 176 spaced from, and approximately normal to, the central axis 170.

An impeller 180 is mounted within the housing 160. The impeller 180 comprises at least one blade 182. The impeller 180 creates an airflow (illustrated by line 184) drawing air through the inlet port 172. The airflow 184 passes through the blades 182 and past a trailing edge 186 of the blades 182. The airflow 184 is expelled through the outlet port 174.

The impeller assembly also comprises a spacer wall 190 which is positioned between the volute 168 and a wall 192 of the outlet port 174. The spacer wall 190 spaces the blade 182 from the outlet port 174 and helps eliminate any discontinuity between the volute 168 and the outlet port 174. As shown in FIG. 16, the outlet port 174 is positioned below the impeller 180 within the volute 168. An exhaust area 200 is reduced in size below the impeller 180 compared to the exhaust area 150 of the impeller assembly of FIG. 14. This is due to space limitations within the prototype. There is no discontinuity at the outlet port 174 as is shown in FIG. 12 for the prior art housing (edge 118).

Figure 17:
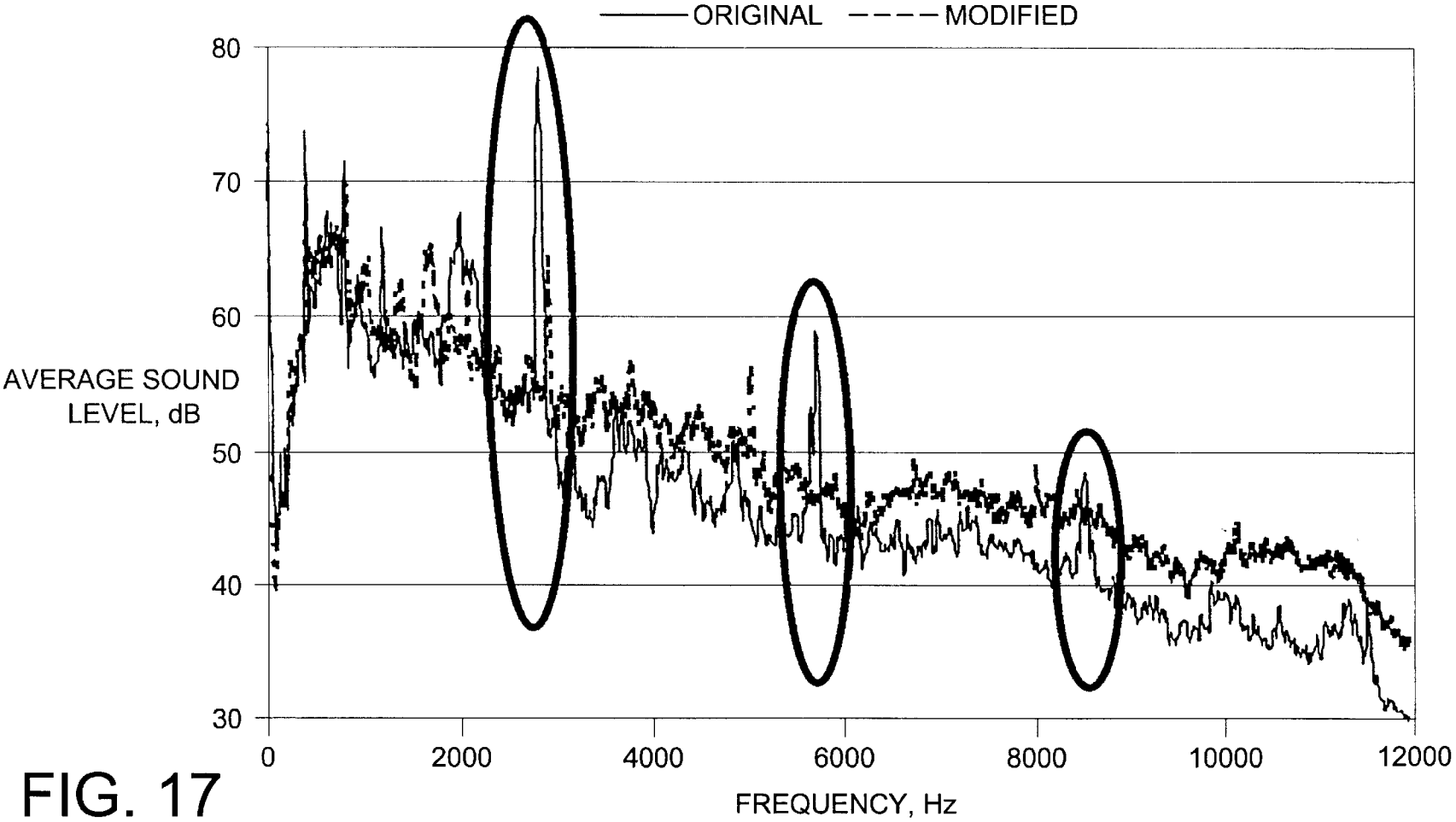
FIG. 17 is a chart comparing average sound level and frequency for the prototype (modified) impeller assembly of FIG. 13 and the original (unmodified) impeller assembly of FIG. 12.

Referring to FIG. 17, sound power measurements were made with the prototype impeller assembly of FIG. 13 and an unmodified impeller assembly of the type shown in FIG. 12. The average sound level is compared to the frequency in FIG. 17. The most significant aspect of the data is that the tone noise at approximately 3,000 Hz is reduced by 15 dB and its harmonics are reduced to levels below the broadband noise levels, as shown within the three circled areas of the plot. The overall noise level was reduced by 3.3 dBA and 36.8 sones, despite the increase in the high frequency noise in the modified unit.

The invention has been described with reference to several preferred embodiments. Obviously, alterations and modifications will occur to others upon a reading and understanding of this specification. It is intended to include all such modifications and alterations insofar as they come within the scope of the appended claims or the equivalents thereof.

Having thus described the preferred embodiments, the invention is now claimed to be:

1. An impeller assembly, comprising:

a shaft;

a housing comprising:

a plurality of walls, wherein one of said walls comprises a volute, a central axis, an inlet port located along said central axis, wherein said shaft is mounted along said central axis, an outlet port spaced from said inlet port, and an exhaust passage which extends from said outlet port;

an impeller mounted on said shaft for rotation, said impeller being located in said housing and comprising:

a hub, and at least one blade extending from said hub; and a plane which is approximately perpendicular to said central axis and extends between said impeller and said outlet port wherein said outlet port is located entirely on a first side of said plane and said impeller is located entirely on a second side of said plane.

2. The impeller assembly of claim 1, wherein said plurality of walls comprises a first wall, a second wall, a side wall connecting said first wall to said second wall, and a third wall extending from said first wall, said third wall forming an inlet passage extending from said inlet port.

3. The impeller assembly of claim 1, wherein said exhaust passage increases in diameter along its length.

4. The impeller assembly of claim 1, wherein said outlet port is of a circular cross-section.

5. The impeller housing of claim 1, wherein said at least one blade comprises a leading edge, a top edge and a trailing edge.

6. The impeller assembly of claim 5, wherein said impeller further comprises a backplate which supports said at least one blade.

7. The impeller assembly of claim 1 further comprising a spacing wall which is positioned between the volute and said wall of said outlet port wherein the spacing wall spaces said impeller from the outlet port, wherein said plane passes through said spacing wall.

8. The impeller assembly of claim 1, wherein a top surface of the impeller is generally parallel to a top surface of the impeller housing and the area between the top surface of the impeller and the top surface of the housing is minimized to reduce noise.

9. An impeller assembly comprising:

a shaft, a two-piece housing comprising:

a central axis, a first section comprising at least one flange, a second section comprising at least one flange, a hole located on each of said at least one flange of said first section and said at least one flange of said second section for mounting said first section to said second section, at least one wall comprising a volute, an inlet port located along said central axis, wherein said shaft extends into said housing, and an exhaust passage which extends from an outlet port; and, an impeller mounted on said shaft for rotation, said impeller being located in said housing and comprising:

a hub, and at least one blade extending from said hub, wherein said impeller creates an air flow drawing air through the inlet port and expelling the air into the outlet port during rotation of said impeller, wherein said, impeller is located entirely on one side of a plane extending between said impeller and said outlet port and said outlet port is located entirely on another side of said plane.

10. The impeller assembly of claim 9, wherein said second section comprises;

at least one wall, and said outlet port.

11. The impeller assembly of claim 9, wherein said first section comprises:

said at least one wall comprising a volute, and said inlet port.

12. The impeller housing of claim 9, wherein said at least one blade comprises a leading edge, a top edge and a trailing edge.

13. The impeller assembly of claim 12, wherein said impeller further comprises a backplate which supports said at least one blade, wherein said backplate is spaced from said outlet port.

14. The impeller assembly of claim 9 further comprising a spacing wall which is positioned between the volute and the exhaust passage wherein the spacing wall spaces the impeller from the outlet port, wherein said plane passes through said spacing wall.

15. The impeller assembly of claim 9, wherein said volute has a uniform cross section and said at least one blade is enclosed within said cross section of said volute.

16. An impeller assembly for reduced noise and improved airflow comprising:

a shaft;

a housing comprising:

a plurality of walls, wherein one of said plurality of walls comprises a volute, a central axis, wherein said shaft is located along said central axis, an inlet port located on said central axis, an outlet port spaced from and oriented approximately perpendicular to said central axis, and an exhaust passage which extends from said outlet port;

an impeller mounted on said shaft for rotation, said impeller comprising:

a hub, at least one blade extending from said hub, a backplate which supports said at least one blade, wherein said impeller creates an airflow drawing air through the inlet port and expelling the air into the outlet port during rotation of said impeller; and said housing further comprising a spacer wall which is positioned between the volute and the outlet port, wherein the spacer wall spaces the at least one blade from the outlet port thus reducing noise and improving airflow.

17. The impeller assembly of claim 16, wherein said plurality of walls comprises a first wall, a second wall, a side wall connecting said first wall to said second wall, and a third wall extending from said first wall, which forms an inlet passage extending from said inlet port.

18. The impeller assembly of claim 16, wherein said at least one blade comprises a leading edge, a top edge and a trailing edge.

19. The impeller assembly of claim 16, wherein said volute has a uniform cross section and said at least one blade is enclosed within said cross section of said volute.

20. The impeller assembly of claim 16, wherein said exhaust passage increases in diameter along its length.

21. The impeller assembly of claim 16, wherein said outlet port is of a circular cross section.

* * * * *